United States Patent [19]

Lothar

[11] Patent Number: 4,812,601

[45] Date of Patent: Mar. 14, 1989

[54] ELECTRICAL TERMINAL

[75] Inventor: Freimuth Lothar, Franklin Lakes, N.J.

[73] Assignee: Magnetek, Inc., Paterson, N.J.

[21] Appl. No.: 111,044

[22] Filed: Oct. 20, 1987

[51] Int. Cl.[4] ..... H01R 4/00

[52] U.S. Cl. ..... 174/94 R; 336/192; 439/485; 439/874; 439/877

[58] Field of Search ..... 174/94 R; 336/192; 439/485, 487, 874, 877

[56] References Cited

U.S. PATENT DOCUMENTS

| | | | |
|---|---|---|---|
| 1,841,317 | 1/1932 | Carlson | 336/192 X |
| 2,486,751 | 11/1949 | McMichael | 336/192 |
| 3,453,375 | 7/1969 | Lundergan | 174/94 R |
| 3,496,504 | 2/1970 | Daley | 336/192 |
| 3,601,750 | 8/1971 | Mancini | 174/94 R X |
| 3,670,298 | 6/1972 | Klumpp, Jr. | 439/877 |
| 4,151,544 | 4/1979 | Riff | 174/94 R X |
| 4,369,572 | 1/1983 | Atkins | 439/877 X |
| 4,554,406 | 11/1985 | Slavin et al. | 174/94 R |

FOREIGN PATENT DOCUMENTS

| | | | |
|---|---|---|---|
| 751052 | 5/1963 | Canada . | |
| 2455046 | 5/1976 | Fed. Rep. of Germany | 336/192 |

*Primary Examiner*—Morris H. Nimmo
*Attorney, Agent, or Firm*—Darby & Darby

[57] ABSTRACT

An improved electrical terminal which is attached to a terminal board having a base section from which extends a pair of spaced arms. One of the arms has its end formed with a notch to accept a relatively small diameter wire to be wound around the arm and the other has a tubular pocket at its end to accept the uninsulated end of a larger diameter wire. The length of the two arms and the terminal base section provide a heat sink to maintain the integrity of the solder connection of the smaller diameter wire wound on and soldered to the one arm at the time of soldering of the larger diameter wire in the pocket on the other arm.

9 Claims, 1 Drawing Sheet

FIG. 1
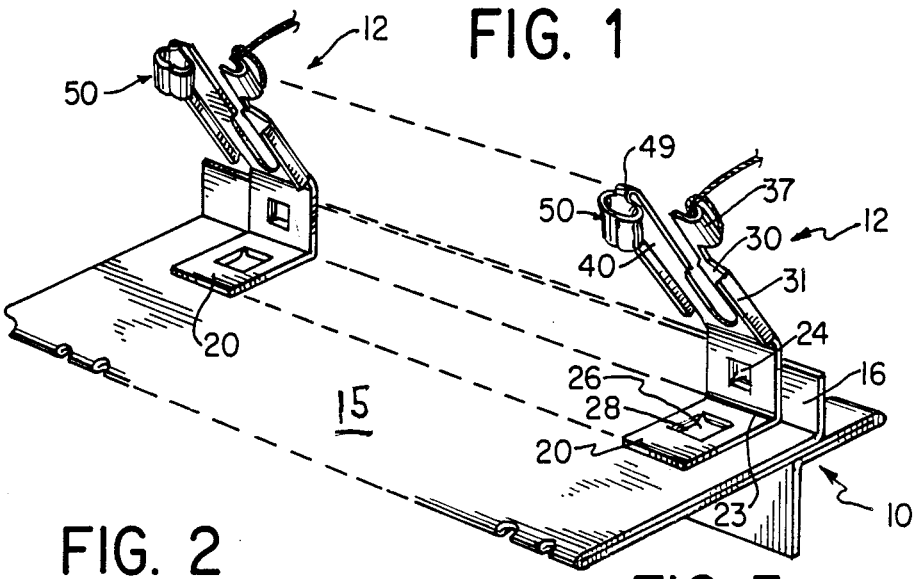
FIG. 2
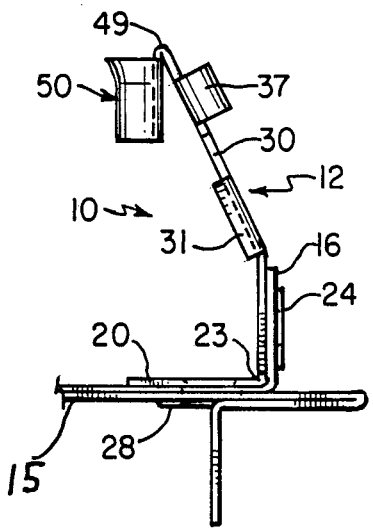
FIG. 3
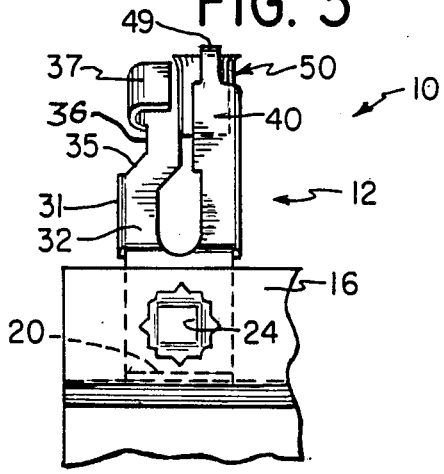
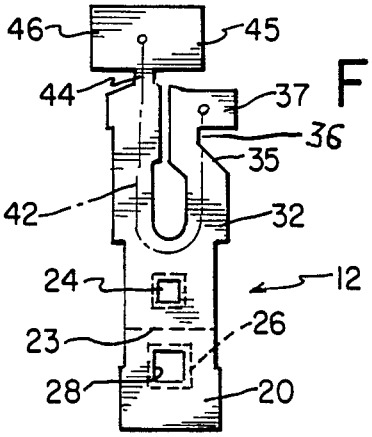
FIG. 4

ELECTRICAL TERMINAL

BACKGROUND OF THE INVENTION

Various types of terminal boards are used in the manufacture of electrical devices, for example ballast transformers for use with fluorescent lamps. In transformers of this type, it often becomes necessary to make a permanent electical connection between a relatively small diameter wire originating from a transformer winding, usually made on a core or bobbin, and a thicker diameter lead wire which can extend external of the ballast transformer housing to make electrical connection, for example, to the power supply for the transformer or be used for a connection within the ballast housing. Such connections between the two types of wire are often made by using a terminal of electrically conductive material, to which one or more of each of the aforesaid types of wire are attached and a solder connection is made.

In terminals in accordance with the prior art, see for example, Canadian Pat. No. 751,052, the magnet wire, which is often of aluminum, is in close proximity to the lead wire on a common terminal. In a typical manufacturing process, for various reasons the wires are soldered to the terminal in two separate steps with the magnet wire being soldered first. Consequently, due to the close proximity of the two types of wires, when heat is supplied to solder the heavier lead wire, it carries over and disturbs the joint between the magnet wire and the terminal. This is an unwanted effect since it detracts from the integrity of the final electrical connection.

BRIEF DESCRIPTION OF THE INVENTION

The present invention relates to a terminal board with an improved terminal having spaced, bifurcated arms connected by a common center piece. One of the arms has a generally tubular portion at its end remote from the center piece for accepting the end of a lead wire and the other arm has a notched area near its end to accept the magnet wire. This provides mechanical stability for the wires on the terminal before and at the time of the soldering operation. The connecting piece between two bifurcated arms provides a heat sink so that when the lead wire is soldered to the terminal, the heat applied is prevented from reaching the first arm so its does not disturb the connection already made between the magnet wire and the terminal.

OBJECTS OF THE INVENTION

It is therefore an object of the present invention to provide an improved terminal board for making electrical connection of various diameter wires.

An additional object is to provide an improved electrical terminal with bifurcated arms, each for receiving and holding a different type of wire, connected by a center piece with the center piece serving as a heat sink.

Another object is to provide an improved electrical terminal for connecting wires of different diameter together having a pair of spaced arms, one of which accepts a wire of relatively small diameter and the other one of relatively large diameter.

Yet a further object is to provide an improved electrical terminal for use in ballast transformers in which the terminal has bifurcated arms extending from a center piece, each of the arms having a mechanical connecting portion for the wire and the connecting center piece between the two arms serves as a heat sink.

BRIEF DESCRIPTION OF THE DRAWINGS

Other objects and advantages of the present invention will become more apparent upon reference to the following specification and annexed drawings in which:

FIG. 1 is a perspective view of a terminal board with the improved terminal thereon;

FIG. 2 is a side elevational view of a terminal in accordance with the invention;

FIG. 3 is an elevational view of the terminal shown attached to the terminal board; and FIG. 4 is a plan view of a stamping for a single terminal before being formed into the final shape.

DETAILED DESCRIPTION OF THE INVENTION

Referring to the drawings, FIG. 1 shows a terminal board 10 having a number of terminals 12 thereon which are made in accordance with the present invention. The terminal board 10 includes a base 15 and an upwardly extending strip portion 16. The terminal board 10 is made of any suitable material, e.g., plastic, paper, etc. In the illustrated embodiment, the terminal board is made of a sheet of paper or a paper-fabric composite which is folded to form the base (two layers) and the upwardly extending strip 16. FIG. 1 shows the board before it is folded into its final form in which the strip 16 would be folded downwardly toward the base 15.

Each of the terminals 12 is formed from a single piece of originally flat electrically conductive metal (see FIG. 4) which has been stamped out and thereafter bent into the desired shape. FIGS. 1–3 illustrate a terminal 12 in its final form after being stamped out and processed into its desired shape. FIG. 4 shows the original flat stamped member.

The terminal 12 includes a base 20 of an originally generally elongated rectangular shape (FIG. 4). A generally square opening 24 is cut in the base 20 near its middle. Closer to the lower end of the base 20, the terminal has a second opening 26 pierced or cut to have four foldable flaps 28. As seen in comparing FIGS. 1 and 2, in mounting the terminal 12 to the terminal board, the terminal base 20 is folded adjacent the line 23, which is between the openings 24 and 26. In assembling the terminal 12 to the terminal board 10, the folded lower part of the terminal having the opening 26 is placed adjacent the base 15 which is formed by folding over layers of the material as shown in FIG. 1. The base 15 of the terminal board either has a hole in it or has one made at the time that the terminal is assembled to the board. For example, there can be a lancing operation which produces the flaps 28, pushes them through the opening 26 and either makes an opening in the board base 15 or pushes the flaps 28 through an opening already existing in the base 15. Flaps 28 are thereafter pressed or peened over the strip 16 as shown in FIG. 2, to fasten the terminal to the strip. The section of the terminal base 20 having the opening 24 rests against the upwardly extending strip 16 and it is fastened to the strip by a rivet or by flaps extending from around the opening and pushed through an folded over the strip 16 as seen in FIGS. 1 and 3.

Referring to FIGS. 1–4, the upper part of the terminal 12 has two bifurcated arms 30 and 40 extending from the base 20. The arm 30 has a lower section 32 which extends outwardly somewhat from, i.e., is wider than, the terminal base 20. Toward the end of the arm 30 there is an indented notch 34 formed by an inwardly angled wall 35 and a straight piece 36 terminating in a tab 37 at the upper end of arm 30. In its original shape (FIG. 4), the tab 37 extends outwardly to about the same width as the center piece 32. In its final shape (FIGS. 1–3), the tab 37 is bent inwardly somewhat in a curved shape toward the center of the terminal 35. As seen in FIGS. 1–3, an extending outer edge 31 on each side of the center part 32 is bent. This makes the arm 30 more rigid.

The other arm 40 has a lower section 42 extending from the terminal base 20. The top end of the arm 40 terminates in a reduced width neck 44 from which extends a pair of flaps 45 and 46. The flaps are originally flat (see FIG. 4) and wider than the arm 40. As shown in FIGS. 1–3, the flaps 45, 46, are folded to form a generally elliptical shaped tubular pocket 50 which is to accept a lead wire. As seen in FIGS. 1–3, the outer edge 31 of the lower section 42 of the arm 40 is bent downwardly to improve the rigidity of this arm.

The tubular pocket is shown (FIGS. 1–3) bent down at the neck 44 towards the terminal base 20. There is a space 55 between the two arms 30 and 40. The bottom part of the space is curved adjacent terminal base 20 and the space is somewhat wider adjacent the lower section 32 of the arm 30 than near the ends of the arm, where the space is narrowed down.

It should be understood that as many of the improved terminals 12 can be mounted on a terminal board strip 16 as needed for a particular application. The terminals are usually made by high speed automatic stamping process. The terminals themselves can be made in strip form and thereafter separated before they are assembled to the strip 16.

In the use of the terminal board and improved terminal of the subject invention, a relatively thin wire, for example of aluminum from the transformer winding, is wrapped over the arm 30 with the notch 34 (not showns) providing an area around which the wire can be wrapped, this being done by hand or by automatic machinery. One or more of the magnet wires can be attached to arm 30 in the area of the notch 34. At this stage, the terminal board 10 is mounted to the ballast transformer (not shown) and connection of the smaller diameter wire can be made at the same time on a number of terminals 12. The entire terminal 12, or plurality of such terminals on the board 10, is then dipped in solder and the magnet wire(s) fastened to the terminal arm 30 is soldered. At this time, the tubular lead wire holding pocket 50 of each terminal dipped in the solder is filled with solder by reflow.

In the next step, the tubular pocket 50 is heated enough for the solder to flow and the lead wire is inserted into the heated pocket. The selective heating of a tubular pocket 50 is accomplished by a soldering iron or hot gas reflow unit or a resistance iron. The path from the pocket 50, through the narrow neck 44, the length of the terminal arm 40, the extended length base section 20, the length of the terminal arm 30 up to where the magnet wire is wrapped around and soldered to the terminal provides a heat sink. The folded terminal base 20 provides a large heat sink area having the one section with the opening 24 attached to the terminal board strip 16 one side exposed to the air and the other section with the opening 26 connected to the terminal board strip 16. Because of this effective heat sink, the lead wire is soldered to the terminal while leaving the connection to the magnet wire intact. That is, the heat which reaches the magnet wire at the time the lead wire is soldered is not sufficient to disturb the solder connection for the magnet wire.

As should be apparent, the terminal of the invention first provides good mechanical connecting stability for the various wires due to the notch 34 and the tubular pocket 50. It thereafter provides effective heat dissipation during the soldering of the large diameter lead wire to the terminal after the connections of the magnet wire has been made.

What is claimed is:

1. A terminal of electrically conductive material comprising:

a generally rectangular base portion, first and second elongated arms lying generally parallel to each other and extending in the same direction from said base portion, said arms being spaced apart with one of said arms being longer than the other, a notch formed adjacent the free end of one of said arms to accept a wire of a first diameter to be wound around and soldered to said one arm, a tubular pocket formed at the free end of the other and longer of said arms for accepting and having soldered thereto a wire of a larger diameter than said first diameter, and said base portion of said terminal serving as a heat sink when heat is applied to one of said arms to prevent the wire connected to the other of said arms from becoming detached.

2. A terminal as in claim 1 wherein said terminal base portion comprises two sections of the electrically conductive material, one folded relative the other.

3. A terminal as in claim 1 wherein said pocket is bent back to lie toward and along the length of said other arm.

4. A terminal as in claim 1 wherein the notch of said one arm is formed by an inwardly angled cut, thereafter a piece of the said one arm being straight but in from the edge of said arm, and then a tab which is generally transverse to the length of said one arm.

5. A terminal as in claim 1 wherein said tubular pocket is formed from at least one flap which extends transversely from said other arm and is folded to form the pocket.

6. A terminal as in claim 5 wherein said pocket is generally elliptical in shape.

7. A terminal as in claim 1 in combination with a circuit board, said base portion of said terminal being connected to said terminal board.

8. A terminal as in claim 2 in combination with a circuit board having a base and an upwardly extending strip, one section of the terminal base portion being connected to the circuit board base and the other section connected to the upwardly extending strip of the board.

9. A terminal as in claim 8 wherein at least one of the sections of said base portions of said terminal is attached to said board by integral flaps extending from said terminal which are attached to said board.

* * * * *